US005681083A

United States Patent [19]

Nelson et al.

[11] Patent Number: 5,681,083

[45] Date of Patent: Oct. 28, 1997

[54] FLAT FURNITURE COMPONENT WITH FOLDABLE FRAME MEMBERS

[75] Inventors: Laurence A. Nelson, Knoxville, Tenn.; William Colatriano, Covington, Ga.

[73] Assignee: P.I., Inc., Athens, Tenn.

[21] Appl. No.: 654,251

[22] Filed: May 28, 1996

[51] Int. Cl.[6] ..... A47C 7/14

[52] U.S. Cl. ..... 297/284.1; 297/284.9; 297/440.12; 297/452.18; 297/284.3

[58] Field of Search ..... 297/284.1, 284.9, 297/284.3, 452.18, DIG. 2, 440.12

[56] References Cited

U.S. PATENT DOCUMENTS

| | | | |
|---|---|---|---|
| 2,607,400 | 8/1952 | Witz | 297/284.9 X |
| 2,670,787 | 3/1954 | Vandas et al. | 297/440.12 X |
| 2,960,149 | 11/1960 | Throssel | 297/440.12 |
| 4,385,782 | 5/1983 | Clark, Jr. | 297/440.12 |
| 4,500,136 | 2/1985 | Murphy et al. | 297/284.9 |
| 4,536,030 | 8/1985 | Sakurada et al. | 297/284.9 |
| 4,653,805 | 3/1987 | Maloney | 297/284.9 |
| 4,679,848 | 7/1987 | Spierings | 297/284.3 X |
| 5,022,709 | 6/1991 | Marchino | 297/284.1 X |
| 5,338,095 | 8/1994 | Laughlin et al. | 297/452.18 X |

*Primary Examiner*—Peter M. Cuomo
*Assistant Examiner*—Rodney B. White
*Attorney, Agent, or Firm*—Lee, Mann, Smith, McWilliams, Sweeney & Ohlson

[57] ABSTRACT

A furniture component, made of plastic, which is molded in a generally flat form having a frame element and foldable frame members which can be displaced in relation to the frame element. A pair of receptors are formed in the frame element adjacent each displaceable frame member, and corresponding limbs are formed on each displaceable frame member for engagement in the receptors. Each of the receptors comprises a cavity and includes a pair of upstanding pegs to orient the frame members at a predetermined angular orientation in relation to the frame element.

12 Claims, 3 Drawing Sheets

FLAT FURNITURE COMPONENT WITH FOLDABLE FRAME MEMBERS

BACKGROUND OF THE INVENTION

This invention relates to furniture, and more specifically to a generally flat or planar furniture component having foldable frame members which may be oriented at predetermined angles in relation to a frame element. More particularly, the invention is directed to a back portion for a chair structure.

In the furniture industry, not only is it important that couches, chairs and other structures be formed to promote comfort and appeal to the aesthetic tastes of the owner, but also it is important, for shipping and storage purposes, that the structure be as compact as possible to reduce costs. A typical upholstered chair has, in the past, been formed by building a chair frame, fully upholstering the frame, and then packaging the chair for shipment to the customer. However, such a chair has a high back extending well above the arms of the chair, and therefore the chair occupies considerable volume, resulting in rather considerable shipping and storage costs.

U.S. Pat. No. 2,670,787 discloses a chair made of malleable material so that the chair can be formed flat, shipped flat and stored flat, but can then be snapped into a configuration forming the chair. Before the chair is formed, it occupies little volume, resulting in reduced shipping and storage costs. However, the structure is not modular, and is not susceptible to being upholstered in its unerected form. Thus, for long term comfort, pads, cushions or other such implements must be employed.

SUMMARY OF THE INVENTION

The invention pertains to a furniture component, such as the back of a chair, which comprises a frame element and at least one displaceable frame member. At least one receptor is formed in the frame element and a corresponding limb is formed on the displaceable frame member and engageable in the receptor. The receptor includes means to orient the limb at a predetermined orientation in the receptor when the limb is engaged therein. Means is provided for joining the displaceable frame member to the frame element to permit relative movement therebetween in order to engage the limb in the receptor. Means is also provided for securing the displaceable frame member to the frame element.

In accordance with the preferred form of the invention, the furniture component is plastic and the joining means comprises a living hinge. Preferably the receptor comprises a cavity, and the means to orient comprises at least one upstanding abutment in the cavity. In the preferred form of the invention, the abutment comprises a pair of pegs. The securing means comprises at least one staple extending through the frame element into the frame member when the two have been appropriately oriented in order to permanently affix the two frame sections at a desired angular orientation.

In the preferred form of the invention, the furniture component is a chair back, with a pair of the frame members extending from opposite sides of the frame element. A pair of receptor cavities, and corresponding limbs, are utilized for engaging each of the displaceable frame members on the frame element.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 2:
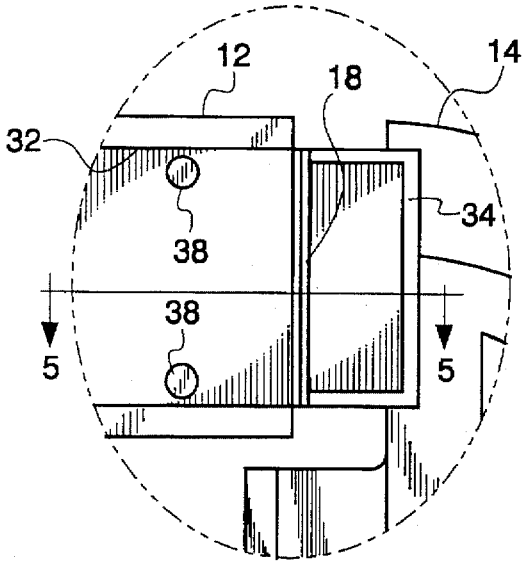
FIG. 2 is an enlarged detail view of encircled area FIG. 2 of FIG. 1.

A furniture component according to the invention is shown generally at 10 in the drawing figures. It is preferred that the furniture component be a molded product, such as an injection molded plastic product, and the particular furniture component 10 shown in the drawing figures is intended for ultimate use as the back portion of a modular chair. Such a chair is shown and described in greater detail in co-pending U.S. patent application Ser. No. 08/646,025, filed May 7, 1996 and entitled Modular Chair, the disclosure of which is incorporated herein by reference.

Figure 1:
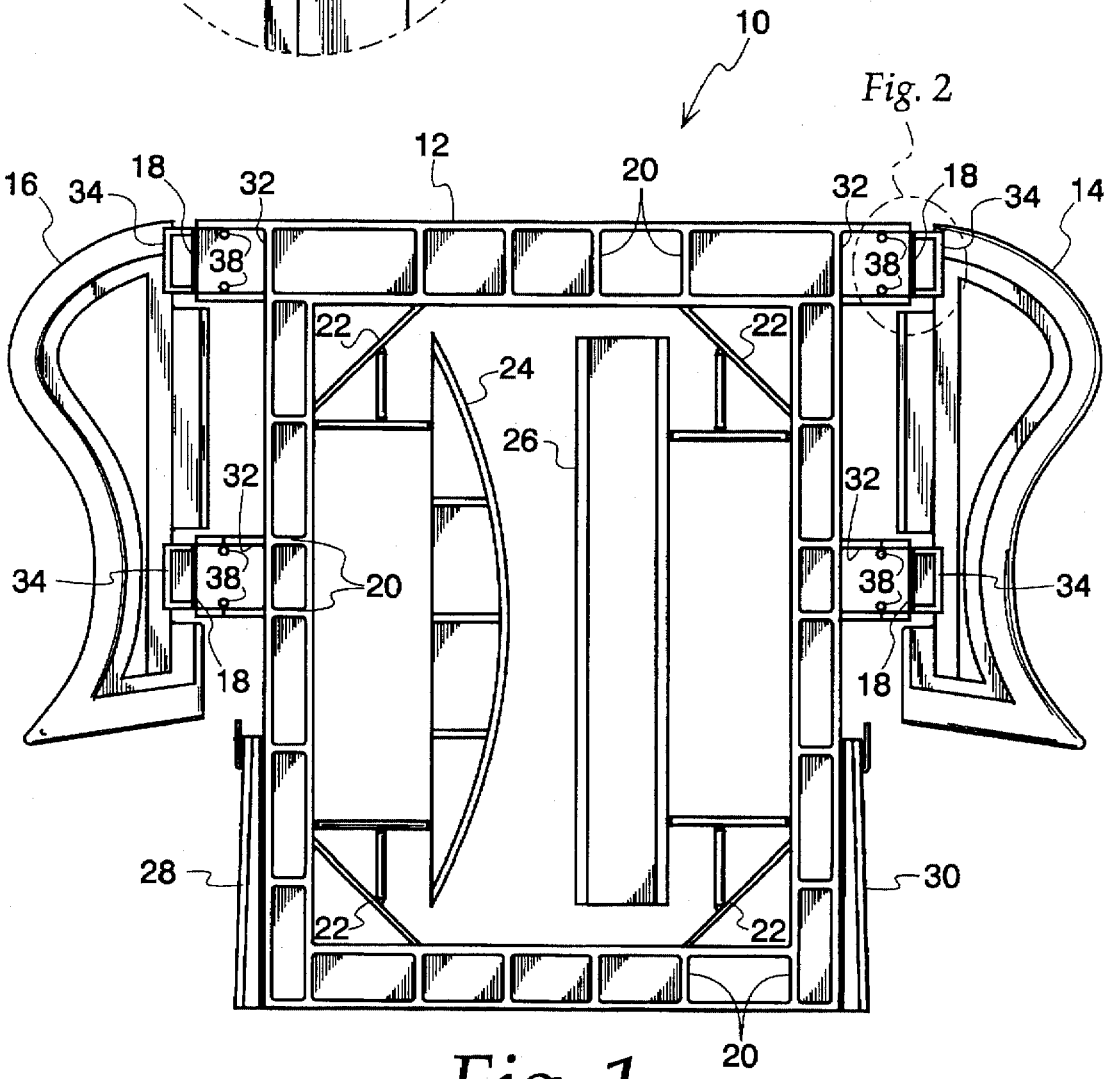
FIG. 1 is a schematic view of a furniture component according to the invention, prior to folding the displaceable frame members.
Figure 3:
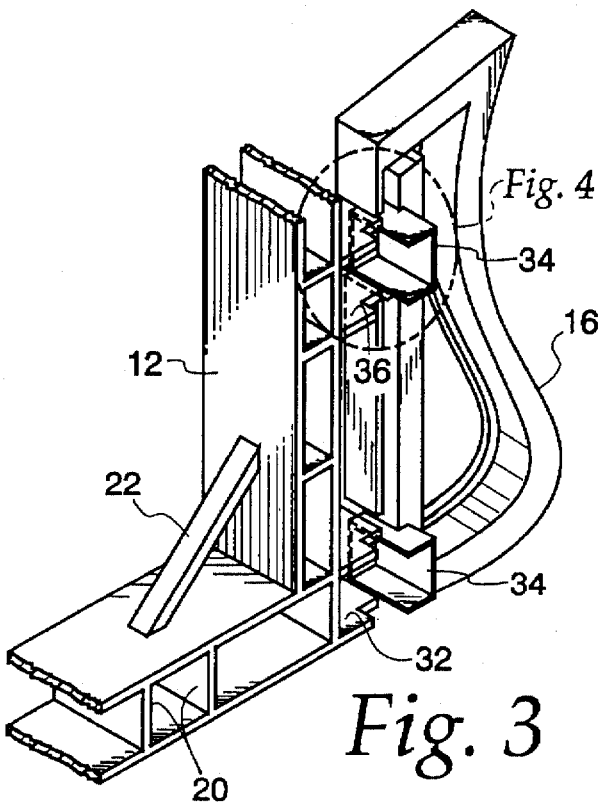
FIG. 3 is a perspective view of one corner of the furniture component according to the invention, inverted in relation to FIG. 1.
Figure 4:
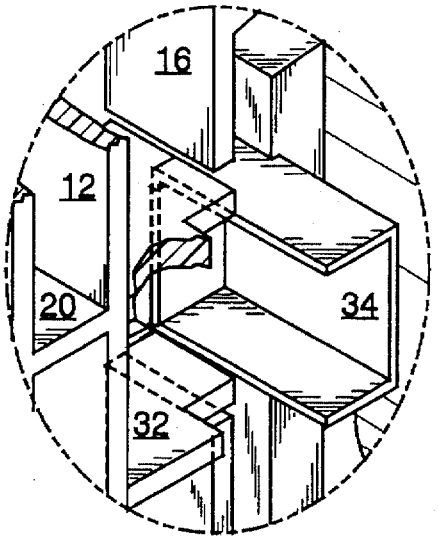
FIG. 4 is an enlarged detail view of encircled area FIG. 4 of FIG. 3.
Figure 9:
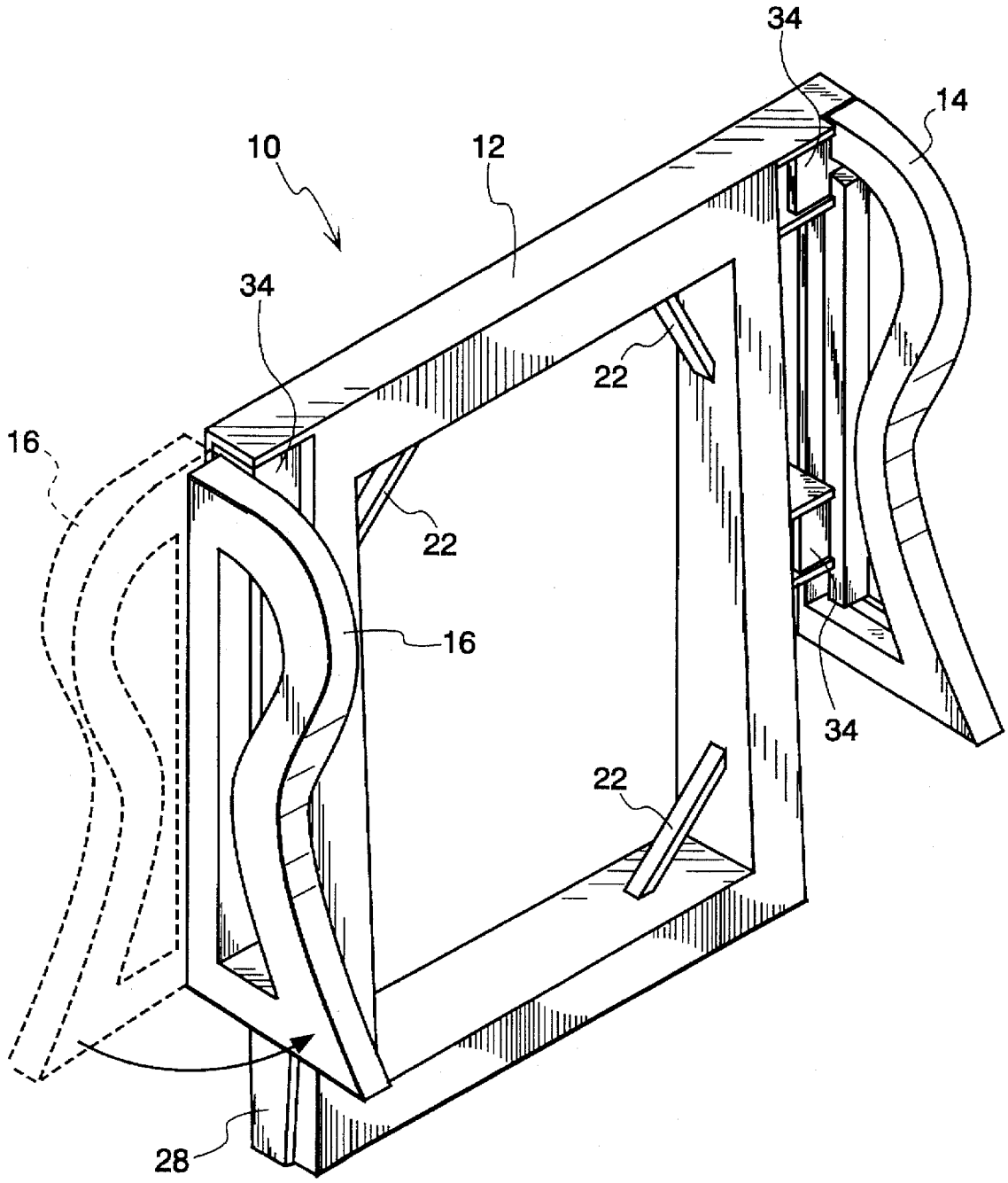
FIG. 9 is a perspective view of a formed furniture component according to the invention, with detail omitted for purposes of simplicity and clarity.

The furniture component 10 as shown in FIG. 1 is generally planar, and is composed of a frame element 12 and opposite displaceable frame members 14 and 16, each of which is secured to the frame element 12 by means of a series of living hinges 18. The living hinges permit the displaceable frame members 14 and 16 to be folded relative to the frame element into the orientation shown in FIG. 9. As thus formed, and as explained in greater detail in incorporated U.S. patent application Ser. No. 08/646,025, the furniture component 10 forms a chair back and can be appropriately upholstered for forming part of a modularly assembled chair.

The frame element 12, as is conventional, can include a series of strengthening ribs 20 throughout. Corner braces 22 can also be employed. Also, because the furniture component 10 is preferably injection molded from plastic, other components 24 and 26 can be molded at the same time, and then broken away to be used as desired. The components 24 and 26 form no part of the present invention.

The frame element 12 also includes opposite taper elements 28 and 30. The taper elements 28 and 30 are used for connecting the furniture component 10, as a chair back, to the seat portion of a chair, as described in greater detail in incorporated U.S. patent application Ser. No. 08/646,025.

Figure 8:
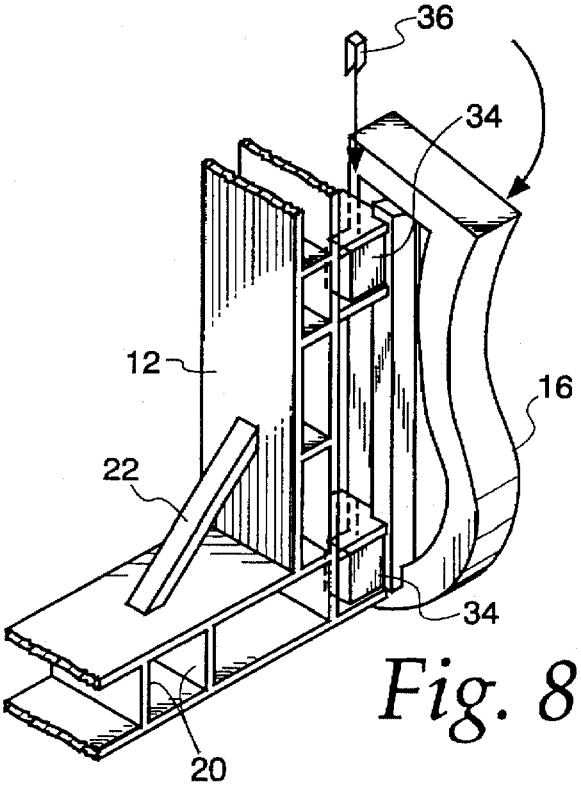
FIG. 8 is a view similar to FIG. 3, but showing the displaceable frame member folded in relation to the frame element, and illustrating staples for permanently fixing the two sections in place.

The frame element 12 also includes a series of molded receptors in the form of cavities 32. The cavities 32 are molded as part of the furniture component 10, and the living hinges 18 extend therefrom, connected to corresponding limbs 34 of the displaceable frame members 14 and 16. As shown in the drawing figures, the limbs 34 are formed to be folded, about the living hinges 18, into the cavities 32 when the displaceable frame members 14 and 16 are folded to the orientation shown in FIGS. 8 and 9. When folded to those positions, a series of staples 36 can be inserted through the cavities 32 into the limbs 34 to permanently fix the displaceable frame elements 14 and 16 in the orientation illustrated in FIGS. 8 and 9.

Figure 5:
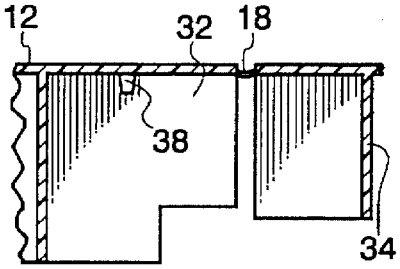
FIG. 5 is a cross-sectional view taken along lines 5—5 of FIG. 2.
Figure 6:
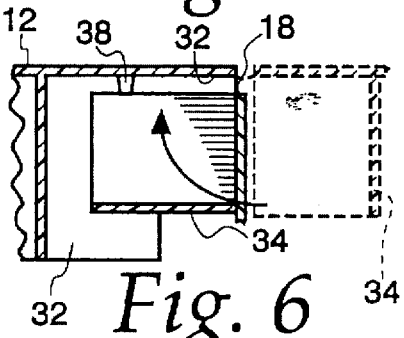
FIG. 6 is a view similar to FIG. 4, but showing the displaceable frame member portion folded into the frame element.
Figure 7:
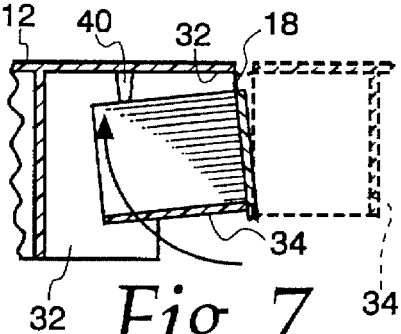
FIG. 7 is a view similar to FIG. 6, but employing a larger abutment.

Each of the cavities 32 also includes a pair of abutments in the form of upstanding pegs 38. The pegs 38 are aligned with the limbs 34 so that when the limbs 34 are folded into the cavities 32, the pegs 38 act as stops. If the pegs 38 have the heights shown in FIGS. 5 and 6, the limbs 34 are folded into the cavities 32 such that the frame members 14 and 16 are essentially perpendicular to the front plane of the frame element 12. However, if a larger peg 40 is employed, as shown in FIG. 7, the frame members 14 and 16 are not folded perpendicular to the frame element 12, but rather are splayed somewhat so that the finally upholstered chair back has splayed wings. Thus, the spread of the wings formed by the underlying frame members 14 and 16 can be adjusted by simply adjusting the heights of the pegs 38.

Various changes can be made to the invention without departing from the spirit thereof or scope of the following claims.

What is claimed is:

1. A furniture component, comprising, a. a frame element, b. at least one displaceable frame member, c. at least one receptor formed in said frame element and a corresponding limb formed on said displaceable frame member adjacent to and engageable in said receptor with said limb seated within said receptor, said receptor including means to orient said limb at a predetermined orientation in said receptor when said limb is engaged in said receptor, d. means joining said displaceable frame member to said frame element to permit relative movement therebetween to engage said limb in said receptor, and e. means for securing said displaceable frame member to said frame element.

2. A furniture component according to claim 1 in which said furniture component is plastic and said joining means comprises a living hinge.

3. A furniture component according to claim 1 in which said receptor comprises a cavity, and in which said means to orient comprises at least one upstanding abutment in said cavity.

4. A furniture component according to claim 3 in which said abutment comprises a peg.

5. A furniture component according to claim 4 including a pair of said pegs.

6. A furniture component according to claim 1 in which said securing means comprises at least one staple extending through said frame element into said frame member.

7. A furniture component according to claim 1 including a pair of said frame members, each frame member including a spaced pair of said receptors associated with each displaceable frame member.

8. A furniture component, comprising, a. a frame element, b. a pair of displaceable frame members, c. two pairs of receptors formed in said frame element, each pair of receptors being associated with one of said displaceable frame members, and a corresponding pair of limbs being formed on each frame member, each pair of receptors being formed on an opposite side of said frame element, d. means joining said displaceable frame member to said frame element to permit relative movement therebetween to engage said limbs in said receptors with said limbs being seated within said receptors, and e. means for securing said displaceable frame member to said frame element.

9. A furniture component according to claim 8 in which each said receptor comprises a cavity, and in which said means to orient comprises at least one upstanding abutment in said cavity.

10. A furniture component according to claim 9 in which said abutment comprises a peg.

11. A furniture component according to claim 10 including a pair of said pegs.

12. A furniture component according to claim 8 in which said securing means comprises at least one staple extending through said frame element into said frame member.

* * * * *